US006682312B1

(12) United States Patent
Ward

(10) Patent No.: US 6,682,312 B1
(45) **Date of Patent: *Jan. 27, 2004**

(54) TANDEM PUMP AND INTERFACE FOR SAME

(75) Inventor: William H. Ward, Mahomet, IL (US)

(73) Assignee: Hydro-Gear Limited Partnership, Sullivan, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/279,329

(22) Filed: Oct. 24, 2002

Related U.S. Application Data

(63) Continuation of application No. 09/702,167, filed on Oct. 30, 2000, now Pat. No. 6,494,686.

(51) Int. Cl.[7] ..... F04B 1/12

(52) U.S. Cl. ..... 417/199.1; 417/222.1; 417/269; 91/502; 91/503

(58) Field of Search ..... 417/199.1, 222.1, 417/269; 92/59, 154; 91/503, 502; 60/486

(56) References Cited

U.S. PATENT DOCUMENTS

| | | | |
|---|---|---|---|
| 4,167,855 | A | 9/1979 | Knapp |
| 4,856,368 | A | 8/1989 | Fujisaka et al. |
| 4,870,820 | A | 10/1989 | Nemoto |
| 4,899,541 | A | 2/1990 | Okada et al. |
| 4,905,472 | A | 3/1990 | Okada |
| 4,914,907 | A | 4/1990 | Okada |
| 4,932,209 | A | 6/1990 | Okada et al. |
| 4,934,253 | A | 6/1990 | Berthold et al. |
| 4,986,073 | A | 1/1991 | Okada |
| 5,042,252 | A | 8/1991 | Havens et al. |
| 5,074,195 | A | 12/1991 | Ohashi et al. |
| 5,094,077 | A | 3/1992 | Okada |
| 5,136,845 | A | 8/1992 | Woodley |
| 5,146,748 | A | 9/1992 | Okada |
| 5,156,576 | A | 10/1992 | Johnson |
| 5,163,293 | A | 11/1992 | Azuma et al. |
| 5,182,966 | A | 2/1993 | von Kaler et al. |
| 5,201,692 | A | 4/1993 | Johnson et al. |
| 5,207,060 | A | 5/1993 | Sheets |
| 5,289,738 | A | 3/1994 | Szulczewski |
| 5,311,740 | A | 5/1994 | Shiba et al. |
| 5,314,387 | A | 5/1994 | Hauser et al. |
| 5,330,394 | A | 7/1994 | Hauser et al. |
| 5,333,451 | A | 8/1994 | Sakikawa et al. |
| 5,335,496 | A | 8/1994 | Azuma et al. |
| 5,339,631 | A | 8/1994 | Ohashi |
| 5,373,697 | A | 12/1994 | Jolliff et al. |
| 5,440,951 | A | 8/1995 | Okada et al. |
| 5,501,578 | A | 3/1996 | Skirde |
| 5,546,752 | A | 8/1996 | Horton et al. |
| 5,555,727 | A | 9/1996 | Hauser et al. |
| 5,588,594 | A | 12/1996 | Sakaura et al. |
| 5,628,189 | A | 5/1997 | Hauser et al. |
| 5,771,758 | A | 6/1998 | Hauser |
| 5,794,443 | A | 8/1998 | Shimizu |
| 5,800,134 | A | 9/1998 | Hasegawa et al. |
| 5,819,537 | A | 10/1998 | Okada et al. |
| 5,862,664 | A | 1/1999 | Ohashi et al. |

(List continued on next page.)

FOREIGN PATENT DOCUMENTS

JP 2001-116107 * 4/2001

OTHER PUBLICATIONS

Daikin Oil Hydraulic Equipment, BDX Series Hydrostatic Transmission, Date unknown.

*Primary Examiner*—Charles G. Freay
(74) *Attorney, Agent, or Firm*—Neal, Gerber & Eisenberg

(57) ABSTRACT

A tandem pump comprising first and second pumps connected in tandem by an interface. Each pump has a housing and an end cap containing hydraulic porting. The interface connects the end cap of one pump to the housing of the other pump.

7 Claims, 11 Drawing Sheets

U.S. PATENT DOCUMENTS 5,873,287 A 2/1999 Kawada
5,887,484 A 3/1999 Abend et al.
5,913,950 A 6/1999 Matsufuji
5,957,666 A * 9/1999 Lee ..... 417/269
6,361,282 B1 3/2002 Wanschura
6,494,686 B1 * 12/2002 Ward ..... 417/199.1
2003/0033803 A1 * 2/2003 Ohashi et al. ..... 60/486

* cited by examiner

| TANDEM PUMP ORIENTATIONS | | | | |
|---|---|---|---|---|
| | FIRST PUMP ORIENTATIONS | | SECOND PUMP ORIENTATIONS | |
| ORIENTATION | TRUNION ARM | PORTS | TRUNION ARM | PORTS |
| 1 | 1 | 1 | 1 | 1 |
| 2 | 1 | 1 | 1 | 2 |
| 3 | 1 | 1 | 2 | 1 |
| 4 | 1 | 1 | 2 | 2 |
| 5 | 1 | 2 | 1 | 1 |
| 6 | 1 | 2 | 1 | 2 |
| 7 | 1 | 2 | 2 | 1 |
| 8 | 1 | 2 | 2 | 2 |
| 9 | 2 | 1 | 1 | 1 |
| 10 | 2 | 1 | 1 | 2 |
| 11 | 2 | 1 | 2 | 1 |
| 12 | 2 | 1 | 2 | 2 |
| 13 | 2 | 2 | 1 | 1 |
| 14 | 2 | 2 | 1 | 2 |
| 15 | 2 | 2 | 2 | 1 |
| 16 | 2 | 2 | 2 | 2 |

FIG. 9

TANDEM PUMP AND INTERFACE FOR SAME

CROSS-REFERENCE TO RELATED APPLICATION

This application is a continuation of U.S. application Ser. No. 09/702,167 filed Oct. 30, 2000, now U.S. Pat No. 6,494,686, which is incorporated herein by reference.

BACKGROUND OF THE INVENTION

The present invention relates to hydraulic pumps, although other uses will be apparent from the teachings disclosed herein. In particular, the present invention relates to tandem pumps and Bantam-Duty Pumps (BDPs).

Generally BDP units provide an infinitely variable flow rate between zero and maximum in both forward and reverse modes of operation. Pumps discussed herein are of the axial piston design which utilize spherical-nosed pistons, although variations within the spirit of this invention will be apparent to those with skill in the art and the invention should not be read as being limited to such pumps. One such prior art pump is shown in FIG. 1. The pump is a variable displacement pump 10 designed for vehicle applications. A compression spring 12 located inside each piston 14 holds the nose 16 of the piston 14 against a thrust-bearing 18. A plurality of such pistons positioned about the center of the cylinder block 20 forms a cylinder block kit 22. The variable displacement pump 10 features a cradle mounted swashplate 24 with direct-proportional displacement control. Tilt of swashplate 24 causes oil to flow from pump 10; reversing the direction of tilt of the swashplate 24 reverses the flow of oil from the pump 10. The pump is fluidly connected with a motor to form a pump-motor circuit having a high-pressure side and a low-pressure side through which the oil flows. Controlling the oil flow direction, i.e. changing the high- and low-pressure sides, controls the motor output rotation. Tilt of the swashplate 24 is controlled through operation of a trunnion arm 26. The trunnion arm is connected to a slide, which is connected with the swashplate 24. Generally, movement of the trunnion arm 26 produces a proportional swashplate 24 movement and change in pump flow and/or direction. This direct-proportional displacement control (DPC) provides a simple method of control. For example, when the operator operates a control shaft, e.g., a foot pedal, that control shaft is mechanically linked to the swashplate 24 resulting in direct control. This direct control is to be contrasted with powered control discussed later.

A fixed displacement gerotor charge pump 28 is generally provided in BDP units. Oil from an external reservoir and filter is pumped into the low-pressure side by the charge pump 28. Fluid not required to replenish the closed loop flows either into the pump housing 30 through a cooling orifice or back to the charge pump 28 inlet through a charge pressure relief valve. Charge check valves 32 are included in the pump 10 and end cap 34 (cap 34) to control the makeup of oil flow of the system. A screw type bypass valve 36 is utilized in the pump 10 to permit movement of the machine (tractor, vehicle, etc.) and allow the machine to be pushed or towed. Opening a passage way between fluid ports with the bypass valve 36 allows oil to flow, thereby opening the pump-motor circuit, which allows the motor to turn with little resistance because the vehicle wheels will not back drive the pump 10.

FIG. 2 shows an exploded isometric view of a symmetric hydraulic pump 40 (also more generally referred to as pump 40) is connected to a motor in a vehicle via hoses. Typically the hoses are high-pressure hoses. Each symmetric pump 40 includes a symmetric housing 42 and a symmetric end cap 44. The housing 42 is rotated relative to the end cap 44 to position a control arm as desired. The term "symmetric" does not imply identical structural symmetry, but rather implies functional or application symmetry. The end cap 44 should be sufficiently functionally symmetric to connect to the housing 42 in one of at least two positions, wherein the other position is rotated relative to the first position. For many applications, the housing 42 and the end cap 44 are rotated 180 degrees relative to one another about a predetermined axis, such as the axis of a pump shaft. In a like manner, a symmetric housing 42 is sufficiently symmetric to achieve an objective whether fitting with an end cap, a vehicle, or the like.

A bypass valve 46, also referred to as a bypass spool, is positioned generally opposite one of the system ports to provide easier access to the bypass valve 46 and a cleaner, more direct, closed loop connection.

The symmetric housing 42 rotatably supports a pump shaft 48. The symmetric end cap 44 includes a porting system discussed more fully, along with pumps generally, in U.S. Pat. No. 6,332,393 (commonly assigned herewith) and incorporated herein by reference. In a symmetric end cap 44 the porting system is preferably bi-laterally symmetric, with regards to the system ports. The porting system includes a pair 51 of system ports (52 and 54) opening external to the end cap 44. The porting system preferably includes a pair of check orifice assemblies that open external to the end cap 44 and connect with the system ports 51.

The porting system generally includes at least one case drain orifice 56 (and may include a pair of orifices) opening external to the end cap 44. The case drain 56 is a drain or connection that diverts excessive fluid (e.g. leakage fluid from the pistons) to a reservoir, thereby reducing pressure in the pump housing 42.

Advantages of the above prior art were not heretofore available because neither a direct displacement tandem pump nor a bantam-duty tandem pump existed heretofore. Tandem pumps are typically of the, relatively, heavy-duty variety and specifically designed to interface with one another. All prior art tandem pumps include an indirect proportional powered control such as a hydraulic and electro-mechanical devices (and combinations thereof) to provide powered control to move the swashplate. So, heretofore, a direct displacement tandem pump did not exist. A particular embodiment of the present invention combines the advantages of a direct displacement bantam-duty pump and a tandem pump; other advantages will be apparent to those with skill in the art from the teachings herein.

SUMMARY OF THE INVENTION

The present invention improves on the prior art by providing a tandem pump comprising pumps connected by an interface, rather than pumps specifically designed for a tandem connection. In a particular embodiment the tandem pump comprises a first pump having a shaft end, a cap end and an oil port; and a second pump axially aligned with the first pump and having a shaft end, a cap end, and an oil port. An interface plate connects the shaft end of the second pump to the cap end of the first pump. A conduit connects the oil port of the second pump with the oil port of the first port.

One embodiment is directed toward a tandem pump comprising direct displacement bantam-duty pumps connected by an interface. Those of skill in the art will understand that the present invention more generally provides a means for creating a tandem pump from pumps not specifically designed for such application.

One embodiment of the invention is directed toward a pump interface for connecting an end cap of a first pump to a housing of a second pump. The interface comprises a first side adapted to mate with the end cap of the first pump; and a second side adapted to mate with the housing of the second pump. A pump lumen (i.e., a passage through the pump), preferably through the center of the interface, allows a pump shaft positioned in the first pump to be coupled to a pump shaft positioned in the second pump.

The present invention may be used to allow standard off-the-shelf pumps, not tandem designed, be placed in tandem. Accordingly, one embodiment of the invention is directed toward an interface kit for connecting two pumps in axial alignment to form a tandem pump.

An object of the invention is to provide two pumps with a single input, i.e., a tandem pump, using non-design specific pumps.

Another advantage is to compensate for tandem pump loads and allow use of lightweight pumps, where tandem pump loads are heavier at the second pump than at a single pump.

Another object is to reduce input connectivity for a tandem pump. A specific object is directed toward eliminating the need for a T-box connection to the individual, linked, pumps. A further specific object is to eliminate the need for a complex belt-pulley input system, e.g., a double pulley system or an elongated belt following a cross-vehicle path may be eliminated while obtaining the advantages of a tandem pump.

Another advantage is that the present invention fits in a smaller space due to simpler pump connectivity. A further object is to provide customized tandem pump orientations with ease.

Other objects and advantages of the present invention will be apparent from the following detailed discussion of exemplary embodiments with reference to the attached drawings and claims.

BRIEF DESCRIPTION OF THE DRAWINGS

FIG. 9 is a table showing the arrangements of pump components to form different tandem pump orientations.

DESCRIPTION OF EXEMPLARY EMBODIMENTS

Figure 1:
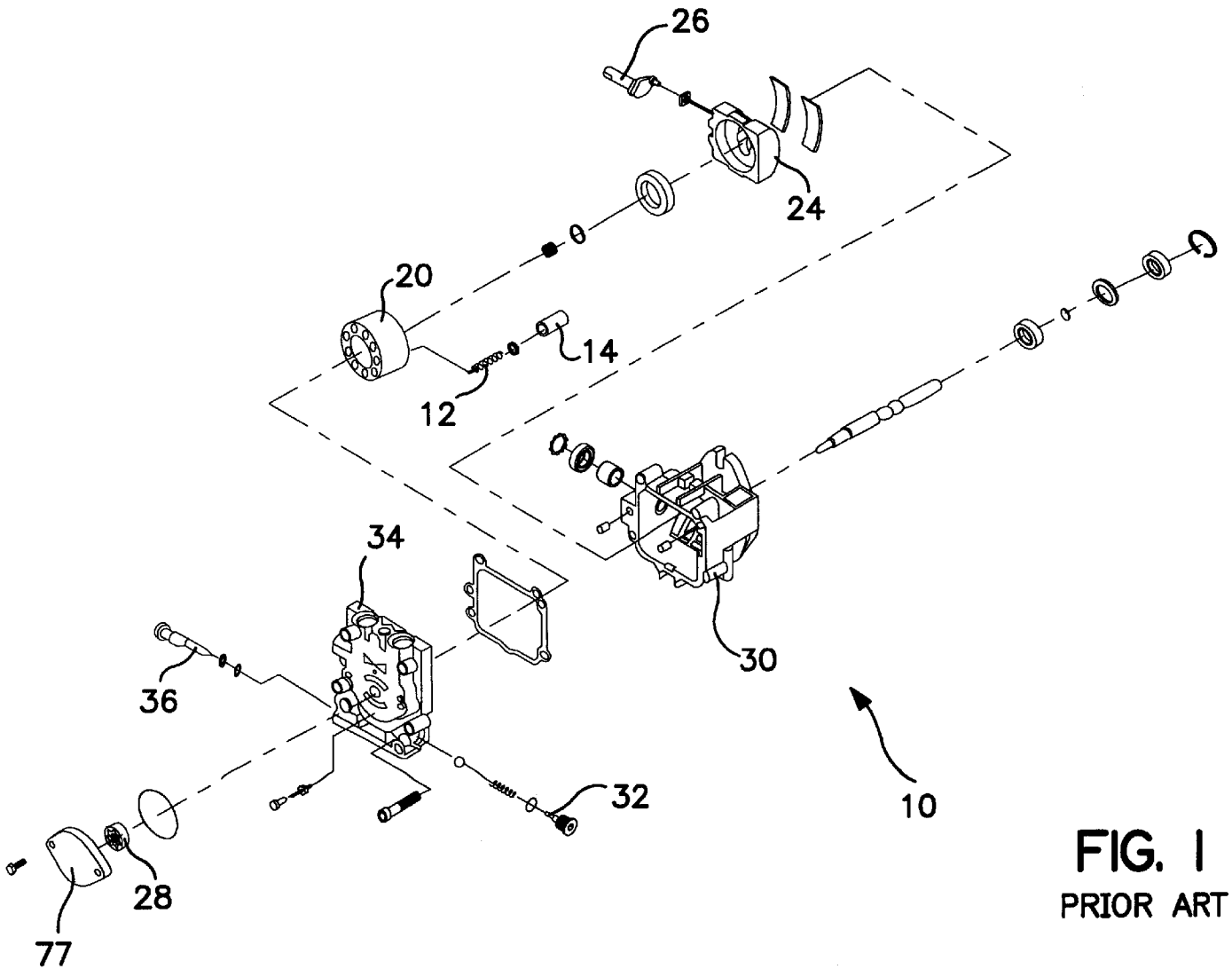
FIG. 1 PRIOR ART
FIG. 1 shows an exploded isometric view of a prior art pump having a preferred alignment.

The present invention is discussed in relation to a hydraulic pump, and in particular, a bantam-duty variable-displacement pump; other uses will be apparent from the teachings disclosed herein. The present invention will be best understood from the following detailed description of exemplary embodiments with reference to the attached drawings, wherein like reference numerals and characters refer to like parts, and by reference to the following claims.

Figure 3:
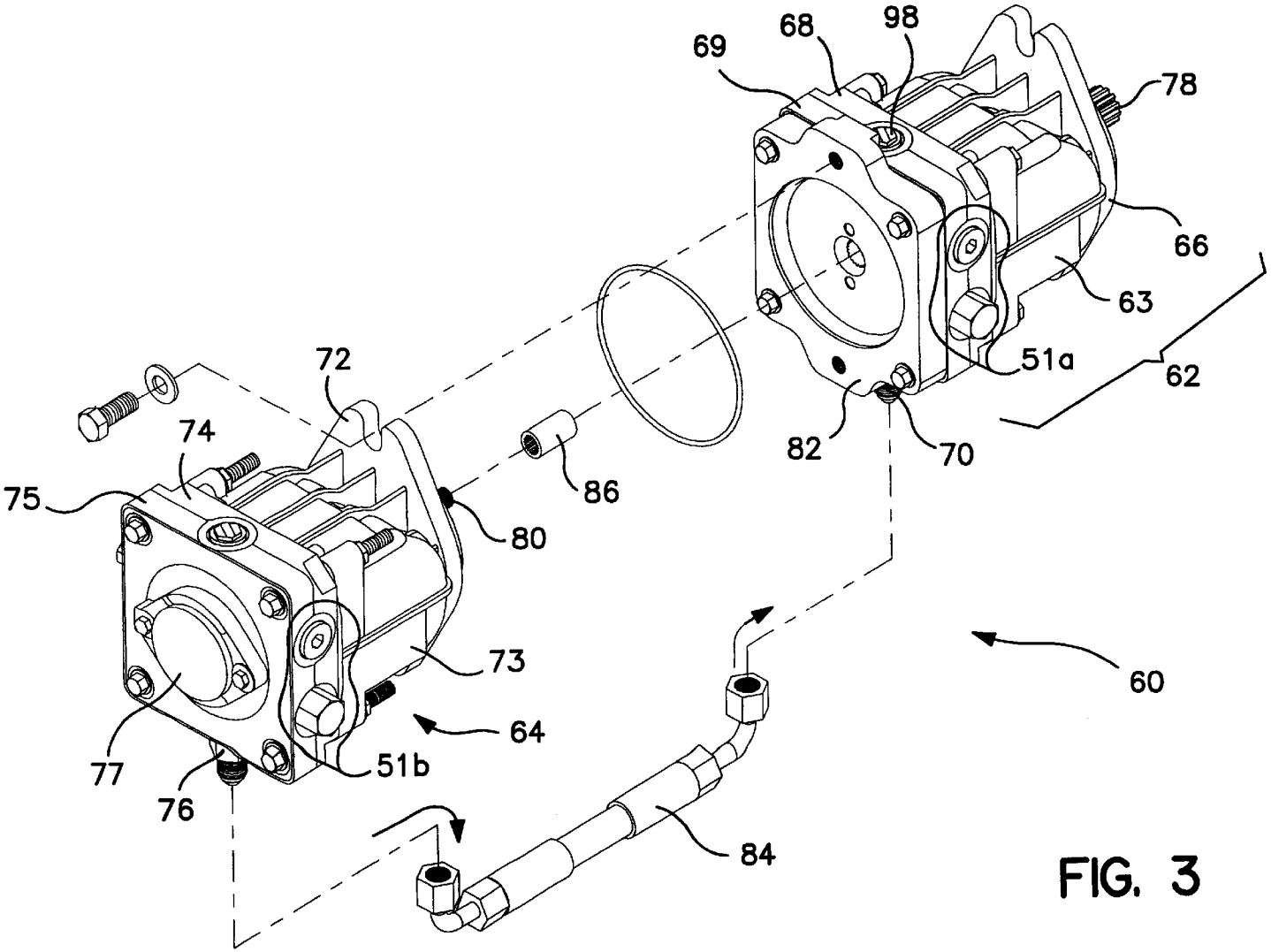
FIG. 3 is a partially exploded isometric view of a tandem pump according to an embodiment of the present invention including an interface for connecting the two pumps.
Figure 4:
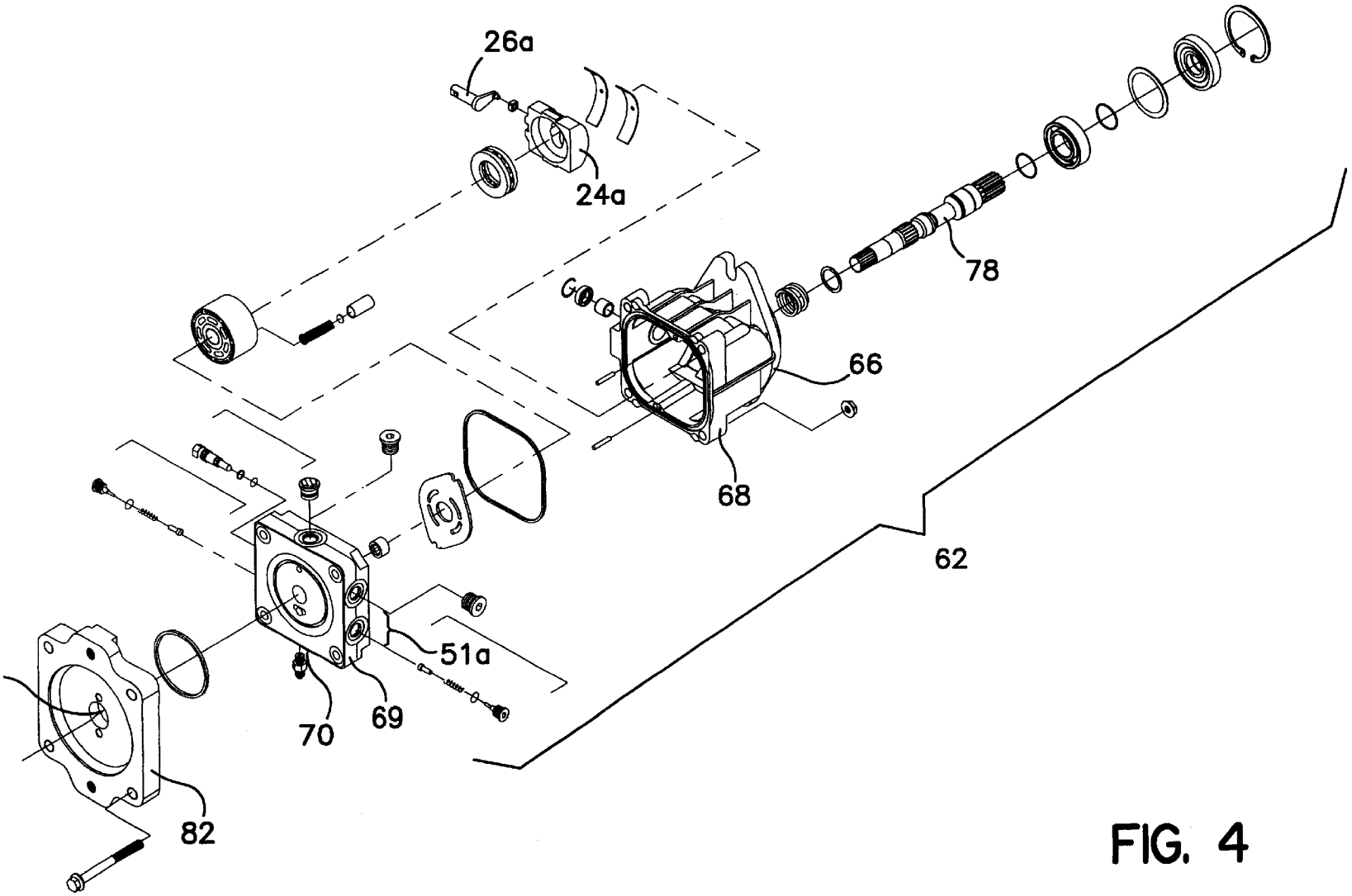
FIG. 4 shows an exploded view including the first pump shown in FIG. 3.
Figure 5:
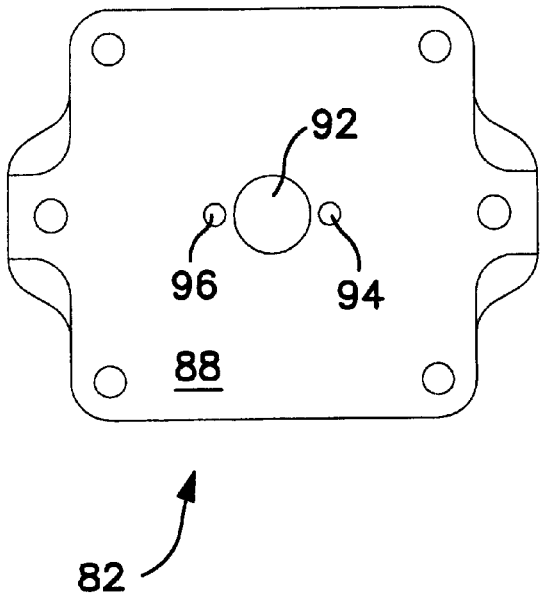
FIG. 5 shows the first side of the interface, wherein the first side is adapted to mate with an end cap.
Figure 6:
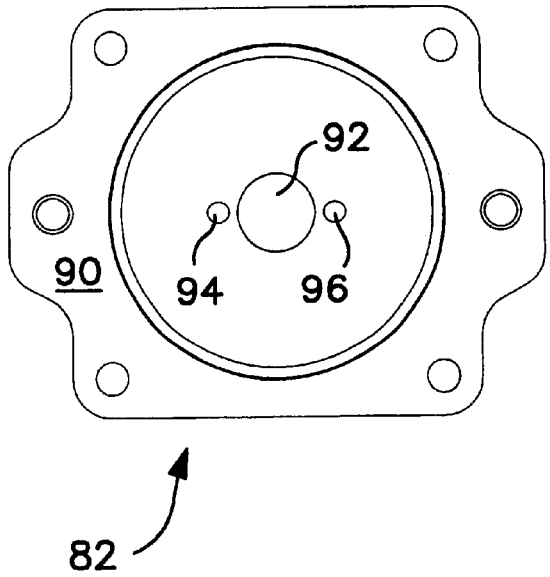
FIG. 6 shows the second side of the interface, wherein the second side is adapted to mate with a pump housing.

FIG. 3 is a partially exploded isometric view of a tandem pump 60 according to an embodiment of the present invention. The tandem pump of FIG. 3 comprises a first pump 62 and a second pump 64. FIG. 4 shows an exploded view including the first pump 62 shown in FIG. 3. The first pump 62 has a shaft end 66, a cap end 68 and an oil port 70. Likewise, the second pump 64, which is axially aligned with the first pump 62, has a shaft end 72, a cap end 74 and an oil port 76. Typically, each pump (62 and 64) has a pump shaft (78 and 80) or input shaft and a gerotor 28 (See FIG. 7) on the second pump 64. The shaft end 72 of the second pump 64 is connected to the cap end 68 of the first pump 62 with an interface, preferably a plate, 82.

The oil ports 70 and 76 of the first and second 62 and 64 pumps are connected with a conduit 84, preferably a hydraulic hose of suitable material. The suitable material is preferably metal connections with rubber there between. The rubber allows for greater tolerance errors and a reduced length conduit. Again, the size of the pump is thereby reduced compared to prior art connectivity means. Finally, the pump shafts 78 and 80 are connected to each other with a coupling 86.

Port 76 is normally a diagnostic port for charge pressure and is accordingly generally capped for most non-tandem applications. Likewise for port 70. In a tandem application, port 76 feeds charge fluid to port 70. This charge fluid feed is desirable because a gerotor may be placed only on the second pump 64. Other designs use internal gerotors with internal fluid passages. This internal fluid passage design generally requires that the pumps be in a fixed orientation, relative to each other. The present invention allows the pumps to be rotated, e.g., around the pump shaft, with relative to each other. This ease of rotation helps provide functional symmetry to obtain a plurality of operable orientations. Still other prior art charge designs use pump designs using a common housing to provide charge pressure to the first pump 62, if needed.

The pump interface 82 preferably comprises a first side 88 adapted to mate with the end cap 69 of the first pump 62 and a second side 90 adapted to mate with the housing 73 of the second pump 64. A pump lumen 92 allows a pump shaft 78 positioned in the first pump 62 to be coupled to a pump shaft 80 positioned in the second pump 64. To facilitate assembly, the interface 82 may be provided with alignment holes (not shown) for receiving alignment pins, or it may be provided with integrated pins. To further facilitate assembly, the interface 82 is provided with a drain orifice 94 and a redundant drain orifice 96. Thus, the interface 82 is adapted to connect to the end cap 69 in one of two positions, wherein the second position is rotated 180°, relative to the first position, about an axis through the lumen 92. Therefore, one of the two drain orifices (94 and 96) is in fluid communication with a drain orifice 98 of the first pump 62, while the other is not. Thus, oil drains from second pump 64 through one of the two drain offices (94 or 96) to the first pump 62, and out of the case drain 98 when the cap is removed. The redundant drain orifice is useful because an assembler need not inspect the interface 82 to determine the proper alignment, thus eliminating a major source of error in assembly.

This ease of assembly and symmetry feature is further aided by connecting the pumps 62 and 64 with the conduit 84 and locating the conduit 84 external to the housings 63 and 73 of the pumps 62 and 64. Such external location of the conduit 84 also eliminates the need for a sump housing large enough to contain the two pumps. A gerotor positioned behind charge pump cover 77 is connected to the cap end 74 of the second pump 64 while charge oil is fed to the first pump 62 through the conduit 84.

Figure 2:
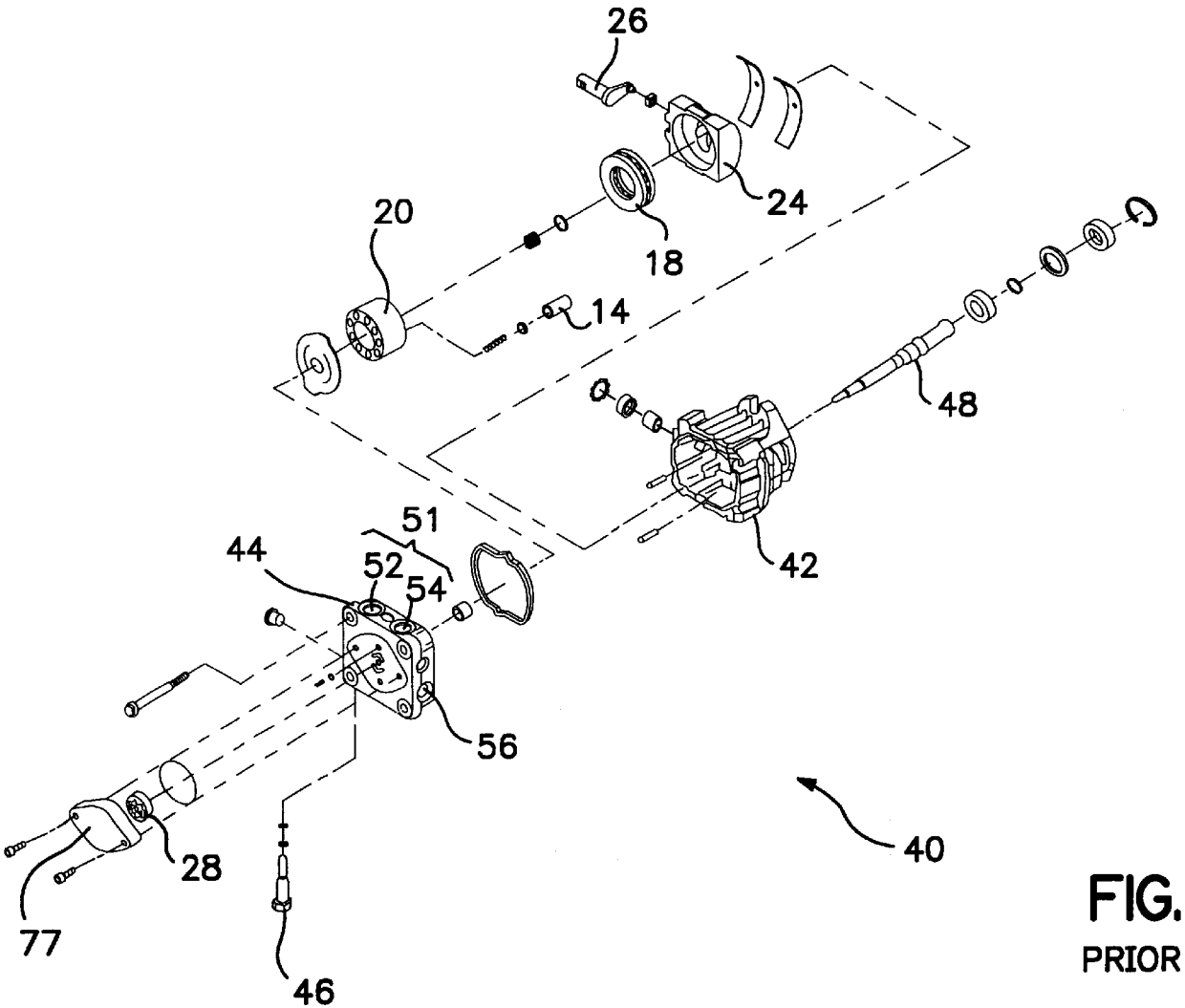
FIG. 2 PRIOR ART
FIG. 2 shows an exploded isometric view of a pump having a symmetric housing and symmetric end plate.
Figure 7:
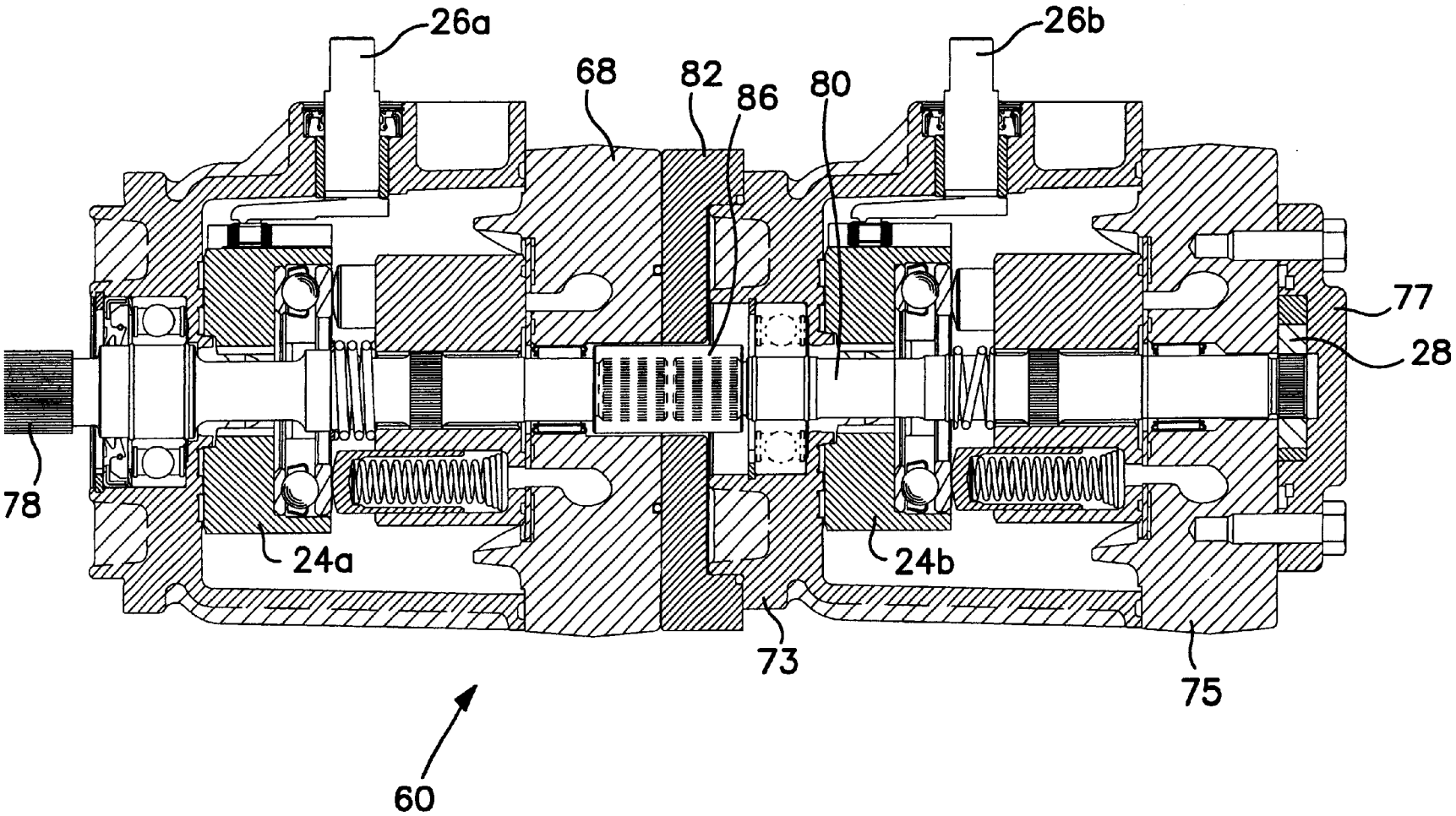
FIG. 7 shows a section view through a tandem pump according to an embodiment of the invention.

To facilitate comparison with FIG. 2 of the prior art, in FIG. 3, the system ports of the first pump 62 are designated 51*a* and the system ports of the second pump 64 are designated 51*b*. Similarly, in FIG. 7, the trunnion arms are designated 26*a* and 26*b* and the swashplates are designated 24*a* and 24*b*. FIG. 7 is a section view through a tandem pump 60.

In a preferred embodiment, the first pump 62 and the second pump 64 are substantially similar and are symmetric bantam-duty pumps. The second pump 64 may be rotated relative to the first pump 62 about an axis through the pump shafts 78 and 80. Accordingly, each pump 62 and 64 may comprise a symmetric pump housing (63 and 73) and a symmetric end cap (69 and 75) connected to the respective housing. The second pump housing 73 may be rotationally aligned with the first pump housing 63 while the second pump end cap 75 is rotated relative to the end cap 69 of the first pump 62. Accordingly, the interface 82 is, for some applications, preferably symmetric.

Figure 8:
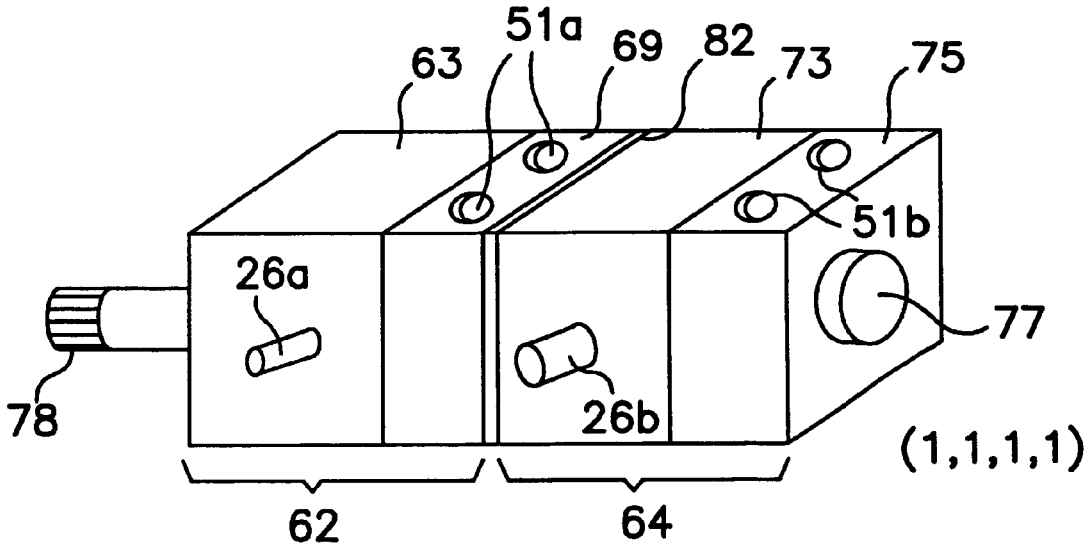
FIG. 8 shows a perspective view sketch of a tandem pump where the trunnion arms and end caps are arranged to place the tandem pump in a first orientation.
Figure 10A:
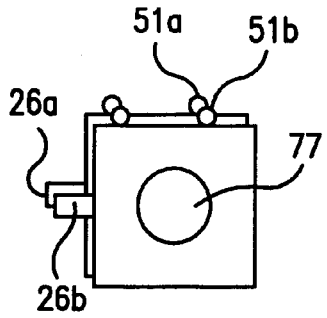
FIG. 10 (FIGS. 10*a*–10*p*) depict end-view sketches of a tandem pump in orientations corresponding to those tabulated in FIG. 9.
Figure 10D:
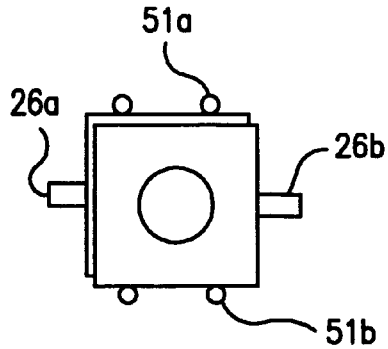
Figure 10B:
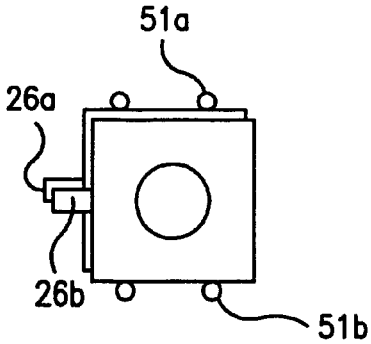
Figure 10E:
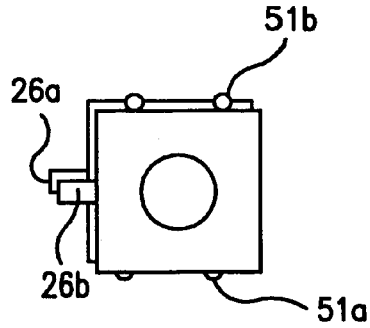
Figure 10C:
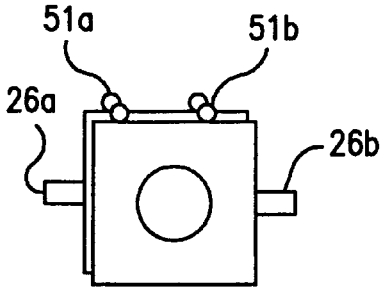
Figure 10F:
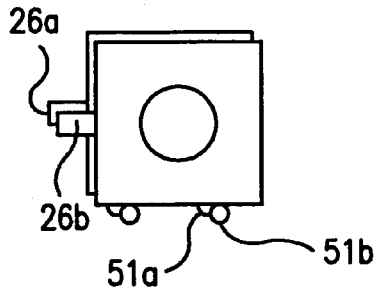
Figure 10G:
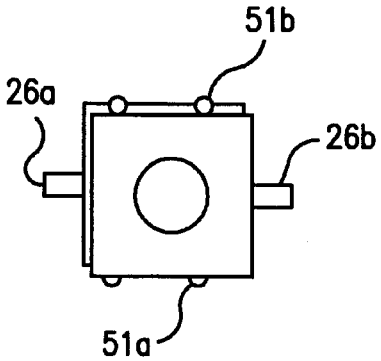
Figure 10J:
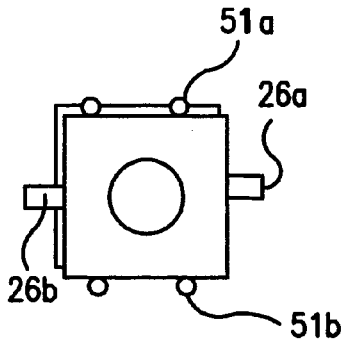
Figure 10H:
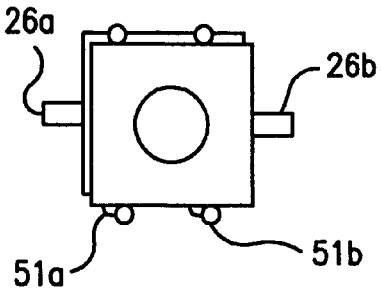
Figure 10K:
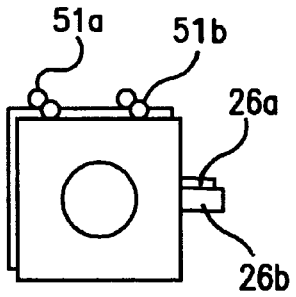
Figure 10I:
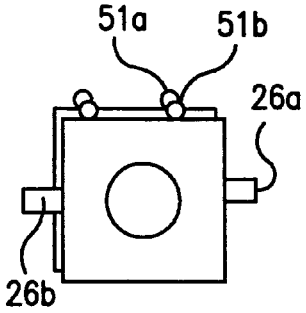
Figure 10L:
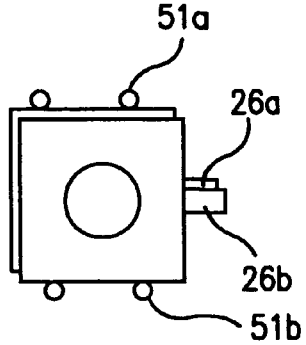
Figure 10M:
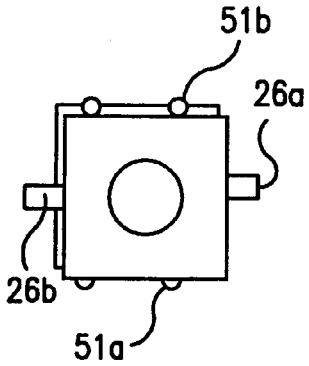
Figure 10P:
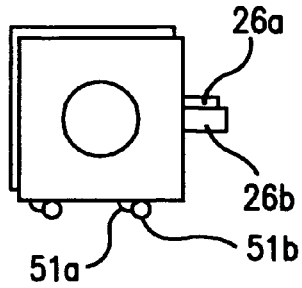
Figure 10N:
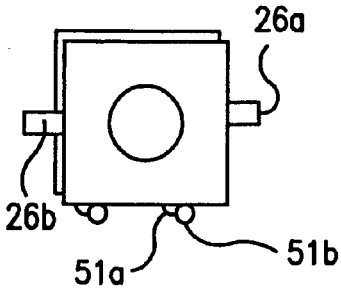
Figure 10O:
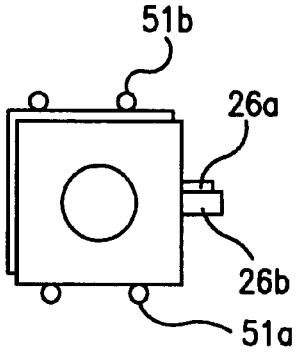

FIG. 8 is a sketch perspective view of a tandem pump shown in a first orientation. Referring to the description of the prior art pump of FIG. 2, the trunnion arms 26 are typically rotatable about the pump shaft 48 in at least two positions, 180° apart. Likewise, for system ports 51 positioned in an end cap 44 connected to a pump housing 42. (See FIG. 2). FIG. 8, which roughly corresponds to FIG. 7, shows the arm 26*a* of the first pump 62 in a first position; the system ports 51*a* of the first pump in a first position; the trunnion arm 26*b* of the second pump 64 in a first position; and the system ports 51*b* of the second pump 64 in a first position. FIG. 9 is a table wherein the positions of the trunnion arms 26*a* and 26*b* along with the positions of the system ports 51 and 51*b* are tabulated with the corresponding tandem pump orientation. FIG. 10 (FIGS. 10*a*–10*p*) show end-view sketches corresponding to the orientations tabulated in FIG. 9.

Manufacturing costs are further reduced because the pumps need not be specially designed for tandem configurations. Off-the-shelf bantam-duty pumps may be connected with an interface kit adapted to connect the pumps in axial alignment to form a tandem pump. An interface kit may, for example, comprise an interface 82 having a first side 88 adapted to mate to a pump housing, a second side 90 adapted to mate to an end cap, and a lumen 92 to allow coupling between pump shafts respectively positioned in the separate pump housings or use of a single pump shaft. The kit may also include a pump shaft coupler 86 adapted to couple two pump shafts in axial alignment. Alternatively, or in addition to the coupler 86, the kit may include an external oil conduit 84 adapted to mate with oil ports in the two pumps.

Thus, although there have been described particular embodiments of the present invention of a new and useful pump, it is not intended that such references be construed as limitations upon the scope of this invention except as set forth in the following claims.

What is claimed is:

1. A pump interface for connecting a first pump to a second pump, wherein said first pump comprises a first housing and a first end cap secured to said first housing and forming a first pump running surface, and said second pump comprises a second housing and a second end cap secured to said second housing and forming a second pump running surface, the interface comprising:

a first side adapted to mate with the end cap of the first pump;

a second side adapted to mate with the second housing of the second pump; and a pump lumen through which a pump shaft positioned in the first pump may be coupled to a pump shaft positioned in the second pump.

2. The interface of claim 1, wherein the interface is adapted to connect to the end cap in one of two positions wherein the second position is rotated 180° relative to the first position about an axis through the lumen.

3. A pump interface for connecting an end cap of a first pump to a housing of a second pump, the interface comprising:

a first side adapted to mate with the end cap of the first pump;

a second side adapted to mate with the housing of the second pump;

a pump lumen through which a pump shaft positioned in the first pump may be coupled to a pump shaft positioned in the second pump; and alignment holes formed in said interface for receiving alignment pins.

4. A pump assembly comprising:

a first hydraulic pump having a first housing, a first pump shaft mounted in the first housing and driven by the first pump and a first end cap mounted to the first housing and including hydraulic porting formed in the first end cap;

a second hydraulic pump connected in a tandem configuration with the first hydraulic pump, the second hydraulic pump having a second housing, a second pump shaft mounted in the second housing and driven by the second pump and a second end cap mounted to the second housing and including hydraulic porting formed in the second end cap;

an interface piece adapted to mate with the first end cap of the first pump and the second housing of the second pump and comprising a lumen into which at least one pump shaft extends and is coupled to the other pump shaft.

5. An assembly as set forth in claim 4, wherein the interface piece further comprises a first side adapted to mate with the first end cap and having substantially the same dimensions as the mating surface on the first end cap; and a second side adapted to mate with the housing of the second pump.

6. A pump assembly as set forth in claim 4, wherein the first pump shaft is collinear with the second pump shaft.

7. A pump interface for connecting an end cap of a first pump to a housing of a second pump, the interface comprising:

a first side adapted to mate with the end cap of the first pump;

a second side adapted to mate with the housing of the second pump; and a pump lumen through which a pump shaft positioned in the first pump may be coupled to a pump shaft positioned in the second pump, wherein the interface is adapted to connect to the end cap in one of two positions wherein the second position is rotated 180° relative to the first position about an axis through the lumen.

* * * * *